US006445298B1

(12) United States Patent
Shepher

(10) Patent No.: US 6,445,298 B1
(45) Date of Patent: Sep. 3, 2002

(54) SYSTEM AND METHOD FOR REMOTELY MONITORING MOVEMENT OF INDIVIDUALS

(76) Inventor: Isaac Shepher, 2211 Queenborough La., Bel Air, CA (US) 90077

( * ) Notice: Subject to any disclaimer, the term of this patent is extended or adjusted under 35 U.S.C. 154(b) by 0 days.

(21) Appl. No.: 09/746,394

(22) Filed: Dec. 21, 2000

(51) Int. Cl.[7] ..... G08B 23/00

(52) U.S. Cl. ..... 340/573.1; 340/426; 340/541; 340/870.07

(58) Field of Search ..... 340/573.1, 426, 340/541, 286.07, 539, 506, 870.07

(56) References Cited

U.S. PATENT DOCUMENTS

| | | | | | |
|---|---|---|---|---|---|
| 4,284,849 | A | | 8/1981 | Anderson et al. | 179/5 R |
| 4,303,801 | A | | 12/1981 | Anderson et al. | 179/5 R |
| 4,524,243 | A | | 6/1985 | Shapiro | 179/5 R |
| 4,838,275 | A | | 6/1989 | Lee | 128/670 |
| 4,858,622 | A | | 8/1989 | Osterweil | 128/782 |
| 4,963,962 | A | | 10/1990 | Kruegle et al. | 358/108 |
| 5,434,611 | A | | 7/1995 | Tamura | 348/8 |
| 5,441,047 | A | | 8/1995 | David et al. | 128/670 |
| 5,558,638 | A | | 9/1996 | Evers et al. | 604/66 |
| 5,717,379 | A | * | 2/1998 | Peters | 340/539 |
| 5,825,283 | A | | 10/1998 | Camhi | 340/438 |
| 5,905,436 | A | * | 5/1999 | Dwight et al. | 340/573.1 |
| 5,982,418 | A | * | 11/1999 | Ely | 348/153 |
| 6,033,129 | A | | 3/2000 | Foye | 396/427 |
| 6,049,281 | A | | 4/2000 | Osterweil | 340/573.4 |
| 6,095,985 | A | | 8/2000 | Raymond et al. | 600/513 |
| 6,101,478 | A | | 8/2000 | Brown | 705/2 |
| 6,130,620 | A | | 10/2000 | Pinnow et al. | 340/825.3 |
| 6,150,941 | A | * | 11/2000 | Geiger et al. | 340/573.1 |
| 6,163,257 | A | * | 12/2000 | Tracy | 340/506 |
| 6,204,762 | B1 | * | 3/2001 | Dering et al. | 340/541 |
| 6,271,752 | B1 | * | 8/2001 | Vaios | 340/541 |

* cited by examiner

*Primary Examiner*—Daniel J. Wu
*Assistant Examiner*—Phung T Nguyen
(74) *Attorney, Agent, or Firm*—Akin, Gump, Strauss, Hauer & Feld, LLP; Alvin R. Wirthlin

(57) ABSTRACT

A system and method for remotely ascertaining movement or non-movement of an individual in order to determine a possible emergency condition. The system includes a plurality of base systems, a central monitoring system, and a plurality of client systems. Each base system is associated with a site to be monitored and includes at least one monitoring device for generating information in response to detected movement of an individual. The central monitoring system is remotely located from the base systems and is coupled thereto for receiving the generated information. The central monitoring system includes a database for storing and retrieving at least a portion of the generated information from each base system. Each client system is remotely located from the base systems and central monitoring system and is couplable to the central monitoring system for retrieving at least a portion of the stored information in the database. In this manner, the client system is able to determine the condition of the individual in a non-intrusive manner. The system can also be used in an alarm mode to determine when unauthorized persons have entered the site.

9 Claims, 8 Drawing Sheets

SYSTEM AND METHOD FOR REMOTELY MONITORING MOVEMENT OF INDIVIDUALS

BACKGROUND OF THE INVENTION

1. Field of the Invention

This invention relates generally to health care monitoring, and more particularly to a system and method for remotely and non-intrusively monitoring movement of individuals at home or other living facilities.

2. Description of the Related Art

Emergency response systems and services, such as provided by Life Alert®, typically include a base unit that is located in the living quarters of a subscriber and connected via telephone line to a monitoring center. A wireless portable call unit may be carried or worn by an individual in the living quarters. When an emergency occurs and the individual is not able to reach a phone, a button on the portable call unit can be depressed. An emergency signal is then sent to the base unit, which in turn notifies the monitoring center that an emergency is in progress. A dispatcher at the monitoring center is then able to directly communicate with the individual through a speaker and microphone on the base unit. The type and seriousness of the emergency can then be ascertained and the appropriate emergency personnel, neighbors, family, and others notified.

Sensing units, such as a smoke detectors or motion sensors, are arranged to send a signal to the base unit when a predetermined event has occurred. The base unit in turn contacts the monitoring center when the signal is received, or when a signal has not been received within a predetermined period of time. By way of example, the base unit can be programmed to send a signal to the monitoring center when a motion sensor has failed to detect movement of a person within a predetermined time period, such as 24 hours. Receipt of the signal at the monitoring center starts a chain of life procedure, where neighbors, family, emergency services, and so on, are contacted and requested to check on the individual. When attempts to contact the individual fail, an entry door or window may be broken by the emergency personnel in order to gain access to the individual's residence and check on the person's health condition. Despite the usefulness of this system, unnecessary damage to living quarters may occur, such as when the individual is on vacation, visiting friends or family for an extended period of time, and so on.

In addition to the above, it is often desirous for relatives, health care providers and other professionals, friends, and so on, to check on the health of an individual, such as an elderly or disabled person, without constant intrusion, especially if the person has difficulty reaching the telephone or door.

Accordingly, there is a need for a system that can ascertain the movement of individuals within a home or other living quarters, where intrusion of the individuals' privacy is minimal, to thereby determine potential emergency situations while minimizing unnecessary damage to homes and other living quarters.

SUMMARY OF THE INVENTION

According to one embodiment of the invention, a system for remotely ascertaining movement or non-movement at a first location comprises a motion detector at the first location adapted to produce a signal in response to movement at the first location. A receiver is adapted to receive the signal and to store information representative of the signal. A client monitor is located remotely from the first location and from the receiver. The client monitor is operable to retrieve information from the receiver indicative of movement at the first location.

According to a further embodiment of the invention, a method for remotely ascertaining movement or non-movement of an individual comprises: providing at least one monitoring device at a first location associated with the individual for detecting movement of an individual; generating information relating to at least one of movement and non-movement of the individual; transferring the generated information from the first location to a second location remote from the first location; and receiving, at a third location remote from the first and second locations, at least a portion of the generated information. In this manner, at least one of movement and non-movement of the individual can be ascertained at the third location.

According to an even further embodiment of the invention, a system for remotely ascertaining movement or non-movement of an individual is provided. The system comprises at least one base system, a central monitoring system, and at least one client system. The at least one base system has at least one monitoring device for generating information in response to detected movement of an individual. The central monitoring system is remotely located from the at least one base system and is coupled thereto for receiving the generated information. The central monitoring system includes a database for storing and retrieving at least a portion of the generated information. The at least one client system is remotely located from the base system and central monitoring system and is couplable to the central monitoring system for retrieving at least a portion of the stored information in the database. In this manner, at least one of movement and non-movement of the individual can be ascertained with the at least one client system.

BRIEF DESCRIPTION OF THE DRAWINGS

The preferred embodiments of the present invention will hereinafter be described in conjunction with the appended drawings, wherein like designations denote like elements, and further wherein.

It is noted that the above-described drawings are intended to depict only typical embodiments of the invention and should not be considered as limiting the scope thereof. The invention will now be described in greater detail with further reference to the accompanying drawings.

DETAILED DESCRIPTION OF THE PREFERRED EMBODIMENTS

Figure 1:
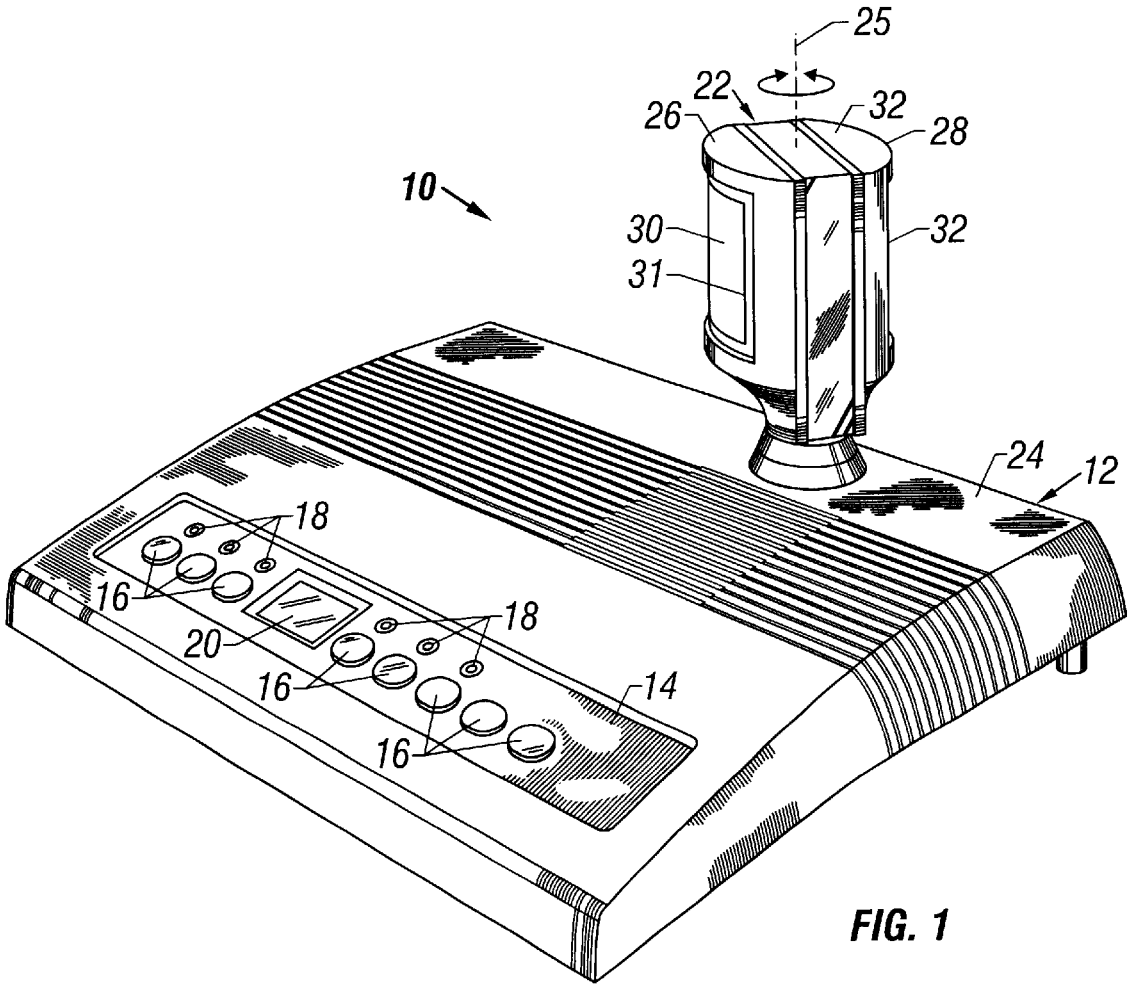
FIG. 1 is a perspective view of an emergency response base system incorporating a monitoring assembly with a pair of motion detectors according to the invention.
Figure 2:
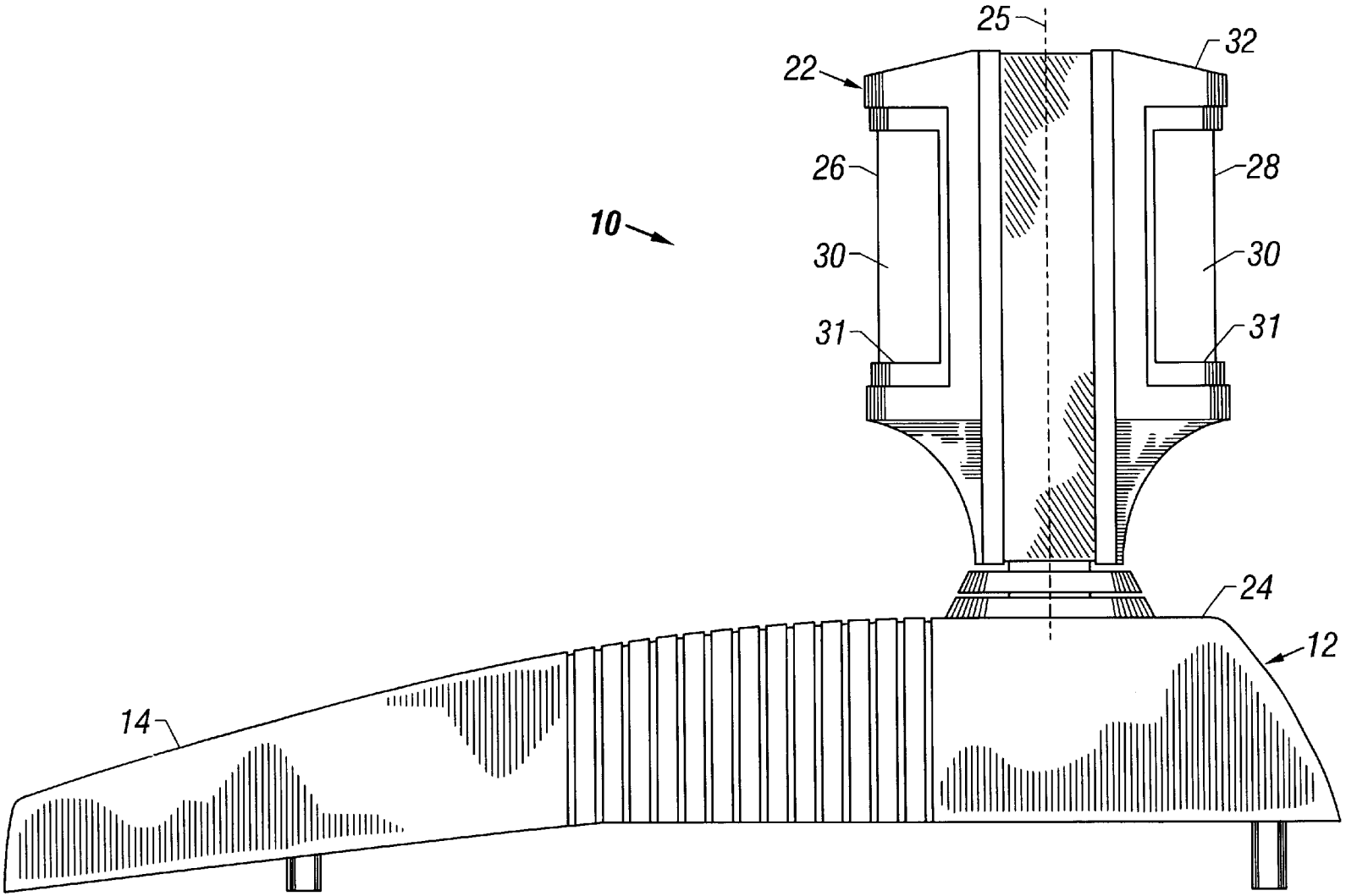
FIG. 2 is a side elevational view of the base system of FIG. 1.

Referring now to the drawings, and to FIGS. 1 and 2 in particular, an emergency response base system 10 according to the invention is illustrated. The base system 10 includes a console or housing 12 with a control panel 14. The control panel 14 includes switches 16, such as push-button switches, pressure switches, toggle switches and so on, indicator lights 18, such as LED's, incandescent lights, neon lights, fiber optics, and so on, to indicate the state of one or more switches, and a display 20 to indicate the particular state of the base system 10.

Although not shown, operational circuitry is located in the housing 12. The circuitry preferably includes a power source, a microprocessor, a communications unit, such as a modem, a memory for storing program instructions and other information, and a programmable memory for storing user-programmable functions, as will be described in greater detail below. Preferably, the programmable memory is of the non-volatile type. The microprocessor, memories, and modem are coupled together in a conventional manner and therefore will not be further described. A speaker and microphone (not shown) may also be associated with the base unit so that a person can communicate with a dispatcher at a central monitoring system 74 (FIG. 7) coupled to the base system 10.

A monitoring assembly 22 extends upwardly from an upper wall 24 of the housing 12 and is rotatable about an axis 25 with respect to the housing 12. Preferably, the monitoring assembly 22 is manually adjustable, but may be rotated automatically and/or remotely in a well-known manner. The monitoring assembly 22 has first and second back-to-back motion detectors 26 and 28, respectively, such that the first motion detector 26 faces a first direction and the second motion detector 28 faces a second direction opposite the first direction. Each motion detector 26, 28 is of well-known construction and may include an arcuate lens 30 mounted in an opening 31 of a detector housing 32 and an infrared detector (not shown) located behind the lens in the detector housing. The infrared detector senses infrared energy emitted by living beings and can operate a relay, switch, logical element, counter, or the like to indicate when the presence of living beings is detected.

With the opposed relation of the motion detectors 26 and 28 and the rotatable nature of the monitoring assembly 22 about the axis 25, the assembly can be adjusted to monitor movement across substantially an entire area, such as a room, corridor, or the like, by centrally locating the base system 10 in the area.

Figure 3:
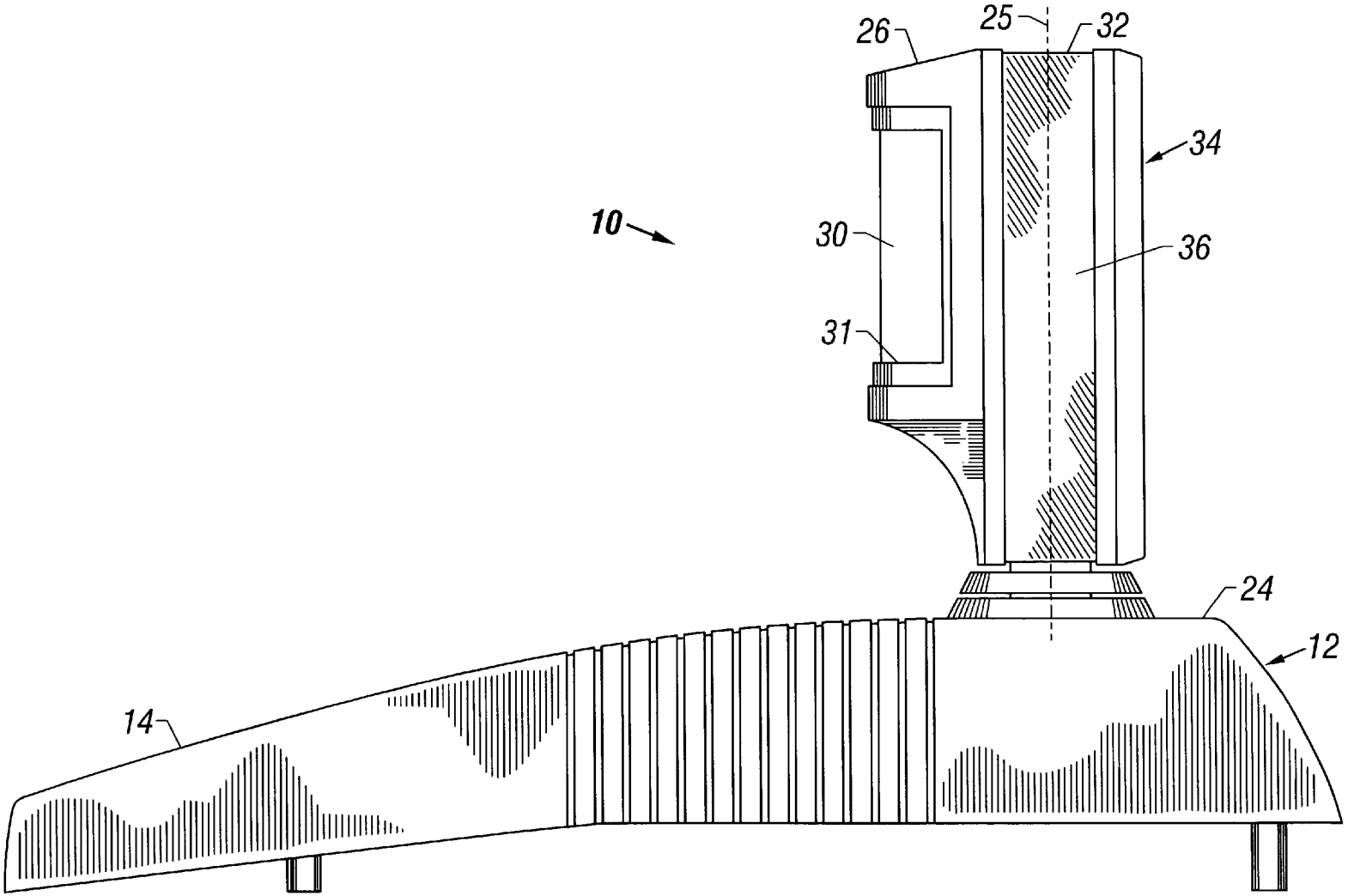
FIG. 3 is a side elevational view of an emergency response base system incorporating a monitoring assembly with a single motion detector according to a second embodiment of the invention.

With reference now to FIG. 3, the base system 10 includes a monitoring assembly 34 according to a further embodiment of the invention, wherein like parts in the previous embodiment are represented by like numerals. As in the previous embodiment, the monitoring assembly 34 extends upwardly from the upper wall 24 of the housing 12 and is rotatable about the axis 25 with respect to the housing 12. The monitoring assembly 34 has a single motion detector 26 which includes an arcuate lens 30 mounted in an opening 31 of a detector housing 36 and an infrared detector (not shown) located behind the lens 30 in the detector housing. The base system 10 can be strategically located in an area, such as a room, corridor, or the like, to monitor movement in the area. Although this embodiment may not be as versatile as the previous embodiment, it is especially useful in areas where the base system 10 is positioned adjacent a wall or other obstruction with the lens 30 projecting into an open area away from the wall.

Figure 4:
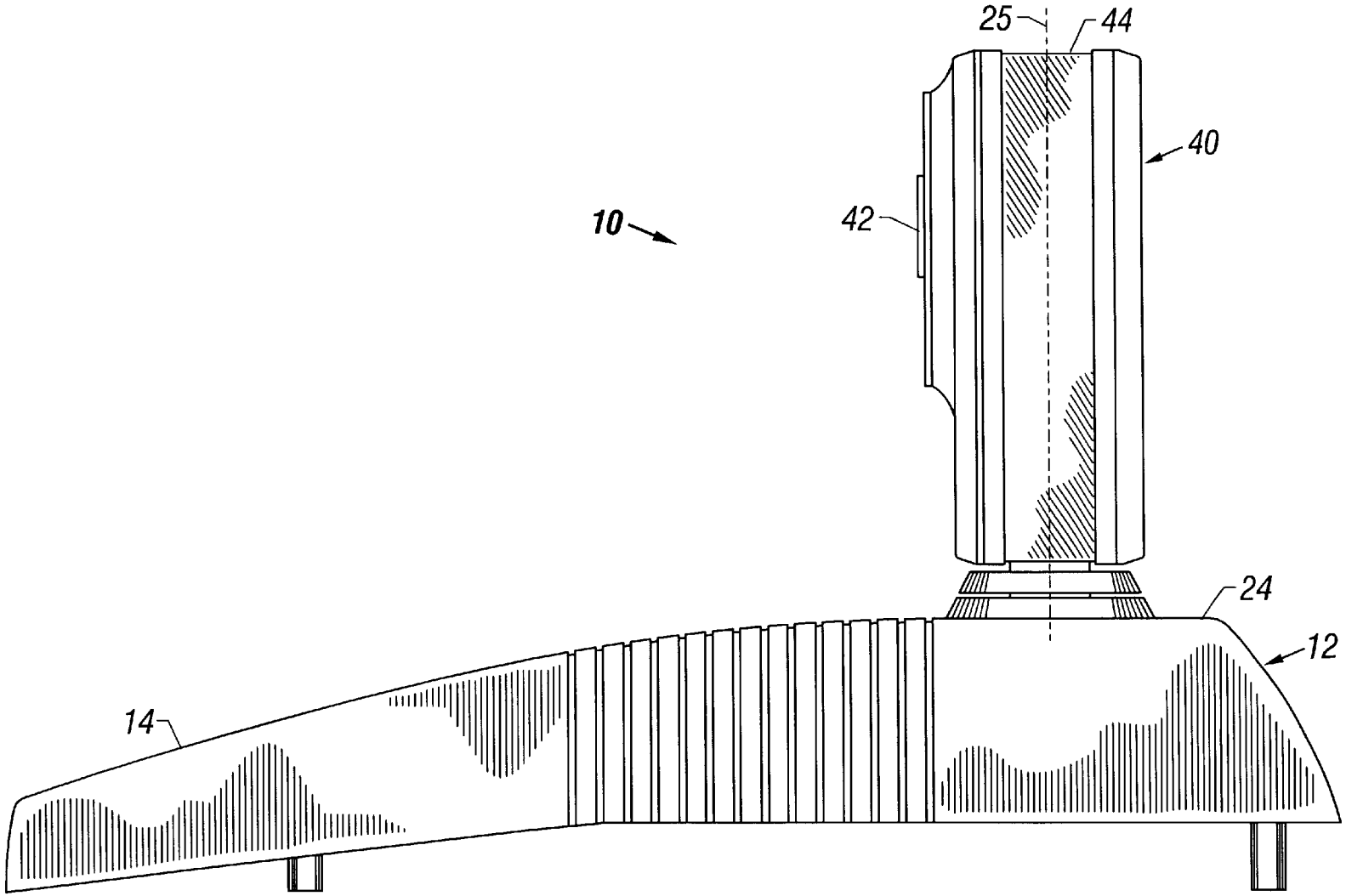
FIG. 4 is a side elevational view of an emergency response base system incorporating a monitoring assembly with a video camera according to a third embodiment of the invention.

With reference now to FIG. 4, the base system 10 includes a monitoring assembly 40 according to a further embodiment of the invention, wherein like parts in the previous embodiments are represented by like numerals. As in the previous embodiments, the monitoring assembly 40 includes a housing 44 that extends upwardly from the upper wall 24 of the housing 12 and is rotatable about the axis 25 with respect to the housing 12. The monitoring assembly 40 includes a camera 42, such as a charge coupled device (CCD) image detector. However, other types of analog or digital sensors may be used, such as, but not limited to, linear scanning and/or multi-dimensional (e.g., two or more) line sensors that cover the infrared (IR) and/or visible light spectrum, and/or other predetermined wavelength (light spectrum) range, or a wide spectral image charge-injection device (CID) camera, and so on. Image data associated with the camera 42 can be stored in the base system 10 and/or sent to a remote location for monitoring, as will be described in greater detail below. The camera 42 may be used to record images of the area and/or to detect movement in the area through well-known image processing techniques, such as disclosed in U.S. Pat. No. 6,049,281, the disclosure of which is hereby incorporated by reference.

Figure 5:
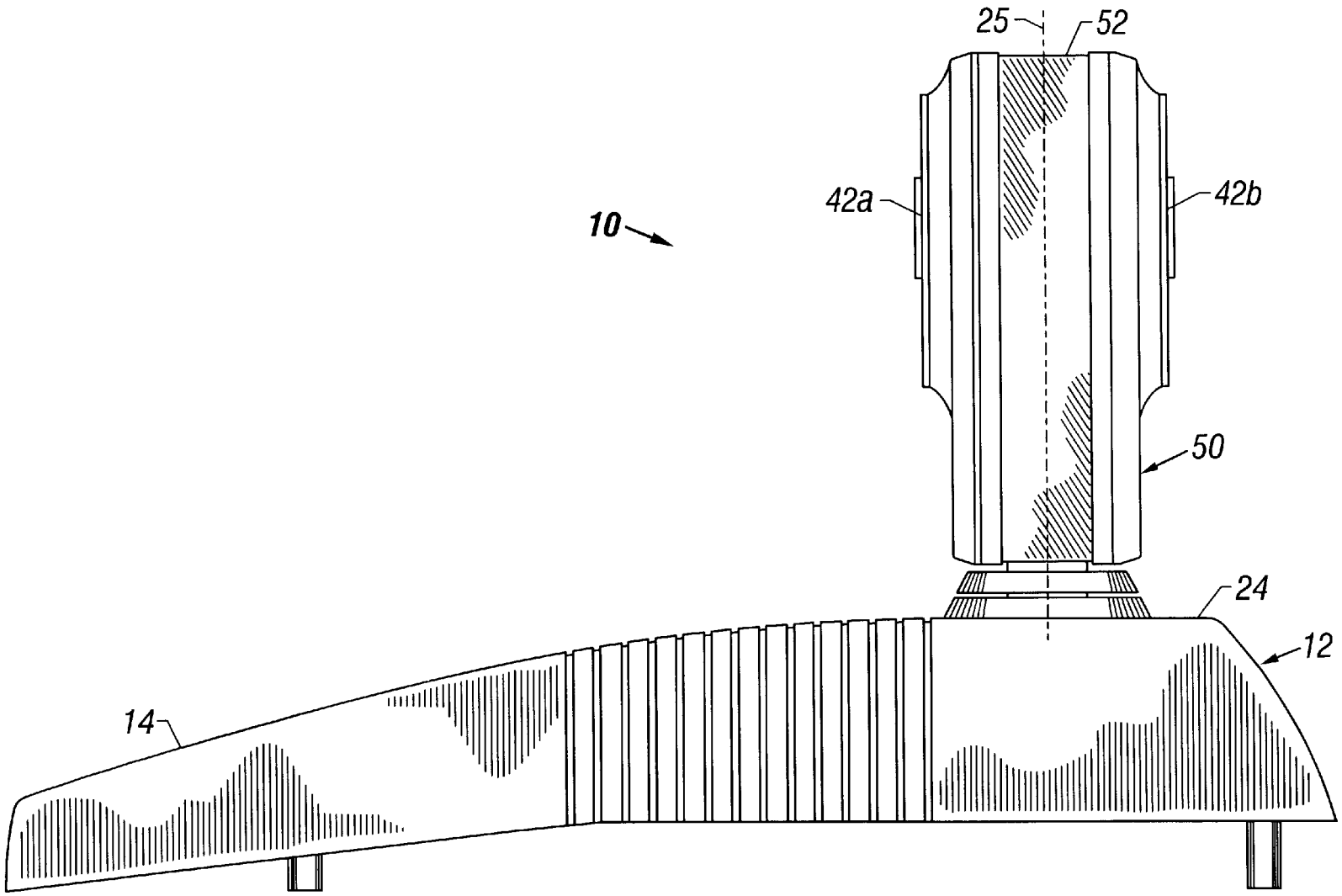
FIG. 5 is a side elevational view of an emergency response base system incorporating a monitoring assembly with a pair of video cameras according to a fourth embodiment of the invention.

Referring to FIG. 5, the base system 10 includes a monitoring assembly 50 according to an even further embodiment of the invention, wherein like parts in the previous embodiments are represented by like numerals. The assembly 50 is similar to the assembly 40, with the exception that two opposing cameras 42A and 42B are provided in back-to-back relation such that one camera 42A faces a first direction and the other camera 42B faces a second direction opposite the first direction. As with the back-to-back motion detectors of the FIGS. 1 and 2 embodiment, the assembly 50 can be adjusted to monitor or record movement across substantially an entire area, such as a room, corridor, or the like, by centrally locating the base system 10 in the area.

Figure 6:
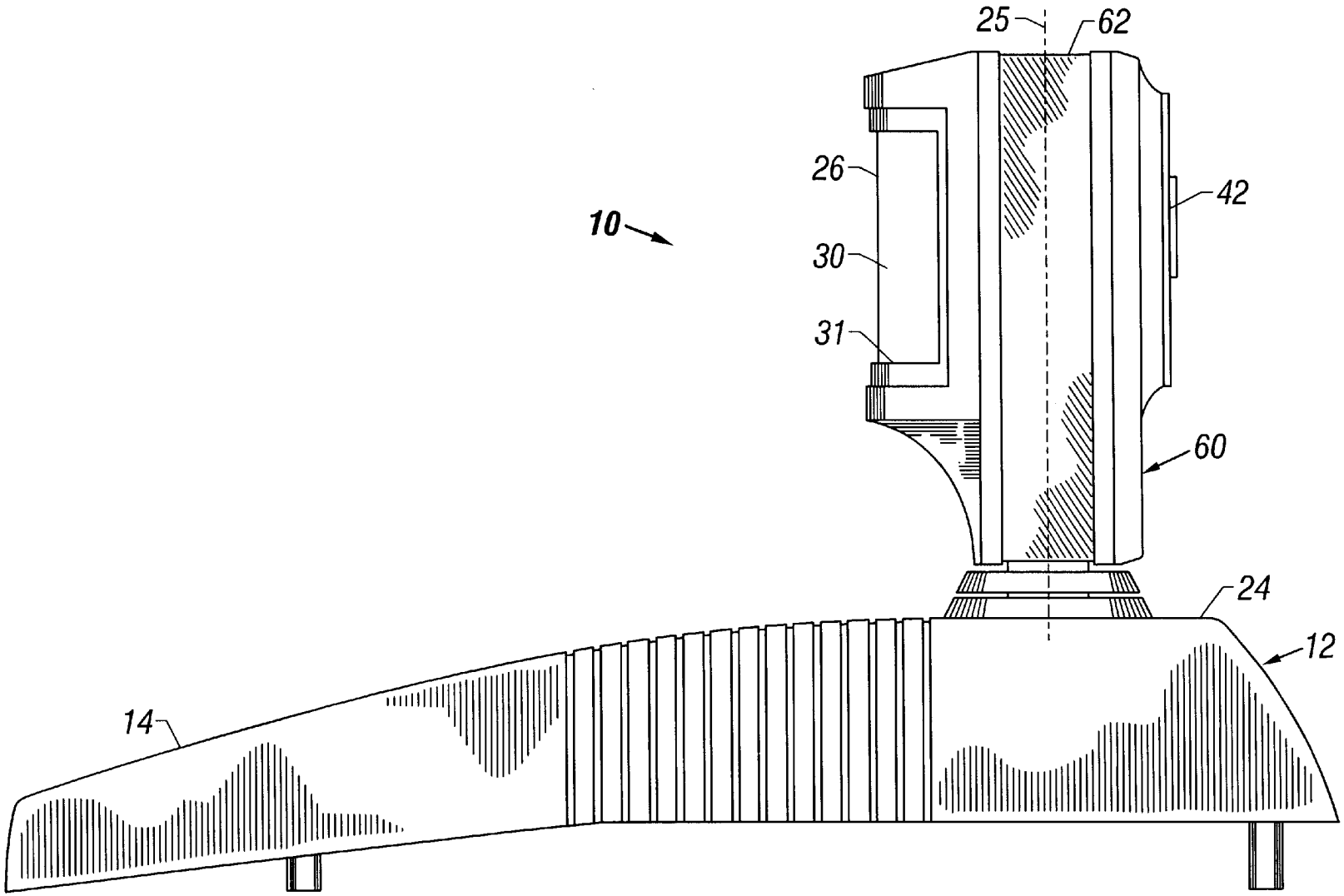
FIG. 6 is a side elevational view of an emergency response base system incorporating a monitoring assembly with a motion detector and video camera according to a fifth embodiment of the invention.

With reference now to FIG. 6, the base system 10 includes a monitoring assembly 60 according to yet a further embodiment of the invention, wherein like parts in the previous embodiments are represented by like numerals. As shown, the assembly 60 includes a housing 62 with a motion detector 26 and a camera 42 mounted to the housing 62. The motion detector 26 preferably faces a first direction, and the camera preferably faces a second direction opposite the first direction. With this arrangement, the motion detector can detect the presence of individuals, and the camera can record and/or transmit images of the area where the base system 10 is located. Although the motion detector and camera are shown facing opposite directions, it is to be understood that they may face the same direction or be oriented at any desired angle about the axis 25. The motion detector and camera can operate separately and independently of each other. Alternatively, the motion detector can trigger operation of the camera when a person or other heat-emitting object is present.

Figure 7:
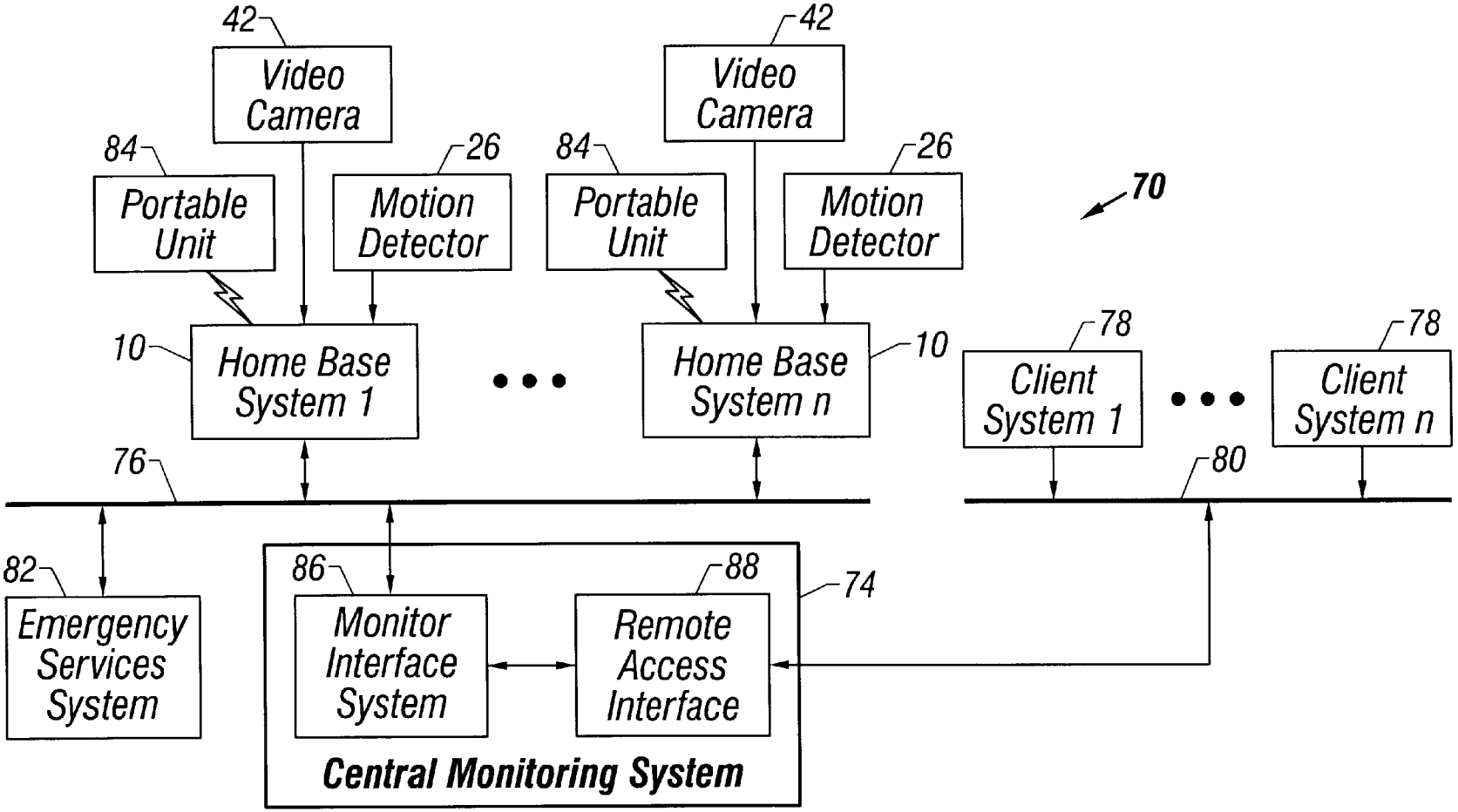
FIG. 7 is a block diagram of a system for remotely monitoring movement of individuals according to the invention.

Turning now to FIG. 7, a system 70 for remotely monitoring movement of individuals according to the invention is illustrated. The system 70 includes one or more subscriber or home base systems 10 coupled to a central monitoring system 74 through a communications medium 76 and one or more client monitoring systems 78 coupled to the central monitoring system 74 through a communications medium 80. An emergency services system 82 can also be coupled to the central monitoring system 74 and/or the base systems 10 through the communications medium 76.

As used herein, the term "couple," and its cognate terms such as "couples" and "coupled", can include a physical connection (such as through a copper conductor), a virtual connection (such as through randomly assigned memory locations of a data memory device), a logical connection (such a through one or more logical devices of a semiconducting circuit), other suitable connections, or a suitable combination of such connections. In one exemplary embodiment, systems and components can be coupled to other systems and components through intervening systems and components, such as through an operating system of a general purpose server platform, a wireless communications system, or other suitable systems and components. Communications media 76 and 80 can be the Internet, a hypertext transfer protocol ("HTTP") connection, an operating system of one or more processing platforms, a local area network ("LAN"), a wide area network ("WAN"), a public switched telecommunications network ("PSTN"), or other suitable connections or combinations thereof.

In one exemplary embodiment of the invention, the communications medium 76 is the PSTN, while the communications medium 80 is the Internet.

The base system 10, client system 78, central monitoring system 74, and the emergency services system 82 can be implemented in hardware, software, or a suitable combination of hardware and software, and can be one or more software systems operating on a general purpose processor platform. As used herein, a software system can be implemented as one or more lines of code, objects, agents, threads, subroutines, two or more separate lines of code or other suitable software structures operating in two or more software applications, on two or more processing platforms, or other suitable software architectures. In one exemplary embodiment, a software system can include one or more lines of code or other suitable software structures operating in a general purpose software application, such as an operating system, and one or more lines of code or other suitable software structures operating in a specific purpose software application. In another exemplary embodiment, a software system can also be implemented as code stored on a suitable data storage medium, software structures operating in conjunction with a processor, or other suitable architectures.

In a preferred embodiment of the invention, a motion detector 26 and/or a camera 42 is coupled to the base system 10, as previously described. Other devices, such as a portable signaling unit 84, and other detectors (not shown) such as window and door detectors, smoke and carbon monoxide detectors, and other motion detectors can be coupled to the home base system 10, preferably through a wireless connection. The portable unit 84 is designed to be carried by a person and includes a switch that can be actuated by the person in the event of an emergency. The switch causes a signal to be transmitted from the portable unit 84 to the base system 10. When the transmitted signal is received at the base unit, the central monitoring system 74 is contacted by the base system 10 through the communications medium 76.

The central monitoring system 74 includes a monitor interface system 86 coupled to the communications medium 76 and a remote access interface 88 coupled between the monitor interface system 86 and the communications medium 80. The monitor interface system 86 includes suitable well known hardware for communicating with the base system 10 and software that receives data sent from the base system 10. The data can then be manipulated and sent to the remote access interface 88 for display on a selected client system 78.

According to one exemplary embodiment of the invention, the central monitoring system 74 includes circuitry (not shown), such as a processor connected in a well-known manner to a memory and a database. The memory stores data, such as instructions and other information used to operate the processor in a well-known manner. The database can include data and other information relating to each of the base systems 10, including identifiers for recognizing each base system. The information may include, but is not limited to, a peak monitoring time period, the number of detected movements during the peak monitoring time period, the number of detected movements outside of the time period, image data from the camera 42, Internet address information relating to each base system 10, and passwords and/or other identifiers for permitting access to base system information from the client systems. It is to be understood that the term "database" as used herein refers to one or more databases. Thus, the information may be located in one or more databases.

The client system 78 running a client application according to the present invention can be coupled to the central monitoring system 74 through the communications medium 80. The client system 78 may be in the form of a personal computer, a hand-held communications device, a wireless phone device, a pager, an interactive television device, an Internet enabled device, or any other device currently in use or that may be developed in the future that can be coupled to the central monitoring system 74.

By way of example, the client system 78 may be operated by a concerned child, parent, friend, health practitioner, or other authorized person or entity that desires to know the activity level of a person at the premises where the base system 10 is located. In this manner, the privacy of the person can be protected while non-intrusive inquiries regarding the activity level of the person can be conducted.

The client system can access the information stored at the central monitoring system 24 through a software system known as a "browser," such as Netscape Navigator™ or Microsoft Explorer™. Browsers allow an end-user to access "web sites," which are server platforms that contain content typically in the form of HTML files. The browser software interprets the HTML data sent by the server and provides the user with graphical images, textual data, audio sound or other forms of output. Alternatively, the client system may have access to the information through automatic e-mail notification or other messaging services. Other traditional software systems, such as games and database or spreadsheet programs, may also be programmed to directly access the information via the Internet connection. These utilities can be implemented as functional software on the central monitoring system 74 or on a server (not shown) associated with the system 74, in conjunction with a browser, with a local software system that operates independently from the server, e.g. a client, or a thin client or other suitable system.

In accordance with an exemplary embodiment of the invention, each base system 10 has a unique Uniform Resource Locator ("URL") address or other suitable data associated with a unique website. The website is preferably provided with a single web page, but can be provided with a plurality of web pages, depending on the type and amount of information to be displayed. Thus, the client system will need to specify the unique URL in order to gain access to the information associated with the particular base system 10.

In a further embodiment of the invention, the client systems 78 have access to only the web page or pages associated with a particular home base system 10 through passwords or other well-known identifiers. Each of the web pages can have one or more hyperlinks to other web pages or websites and may also include *.HTML (hypertext markup language) data, *.XML (extensible markup language) data, *.JPEG (joint photographics experts group) data, *.BMP (bitmap) data, or other suitable data for subsequent processing by a web browser system operating on the client systems 78 or other suitable systems. In this manner, information gathered by the central monitoring system from one or more of the base systems 10, including image information from one or more cameras, motion information from one or more motion detectors, vacation mode status (as will be described in greater detail below), and so on, can be gathered, stored, and displayed on the web page or web pages associated with a particular base system 10.

Figure 8:
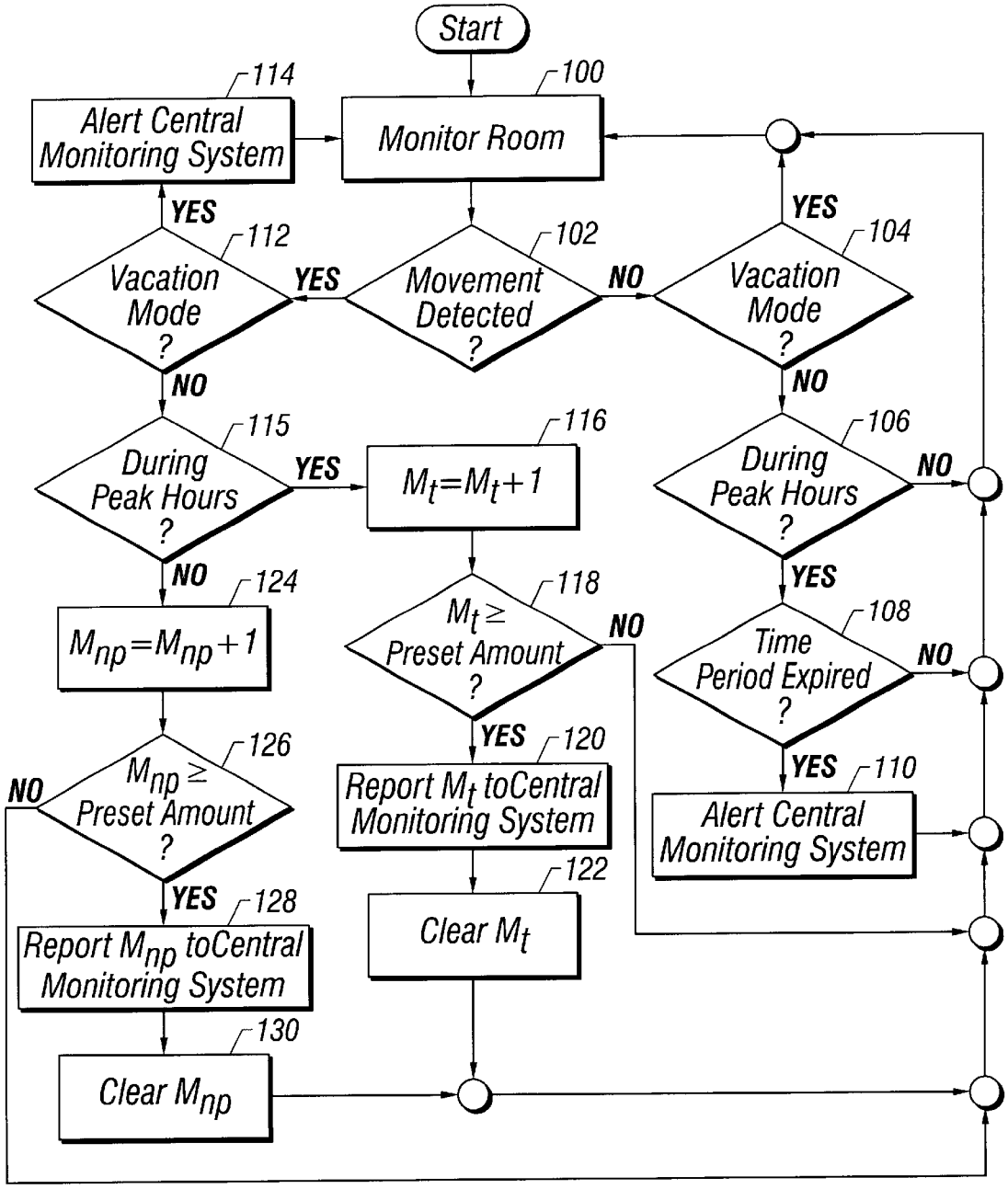
FIG. 8 is a block diagram of a method for remotely monitoring movement of individuals according to the invention.

With reference now to FIG. 8, a method for remotely monitoring movement of individuals according to the invention is illustrated. The method includes constantly monitoring a room, corridor, and/or other area (block 100) with one or more motion detectors 26 and/or cameras 42. A plurality of motion detectors can be located in different areas of a residence or other structure in order to detect movement of a person, such as in a kitchen, living room, and so on.

At block 102, it is determined whether movement from any of the motion detectors has been detected. If not, an inquiry can be made to determine whether the base system 10 is in a vacation (alarm) mode at block 104. The vacation mode can be programmed in the base system 10 by a person when going on vacation or otherwise leaving the area associated with the base system for a period of time. If the base system 10 is in vacation mode and no movement has occurred, the base system continues to monitor the area.

If the base system 10 is not in vacation mode, then it is determined at block 106 if no movement has occurred during peak hours of movement. The peak hours are preferably programmed into the base system 10 by the user or other individual, but can be predefined at the central monitoring system 74. The peak hours may be programmed into the base system 10 by manipulating certain switches 16 on the control panel 14. By way of example, peak hours can be defined between 8:00 a.m. and 9:00 p.m., 7:00 p.m. and 10:00 p.m., or any other time interval, depending on the normal activity level and routine of the person or persons being monitored.

If no movement has been detected outside of the predefined peak hours by any of the motion detectors, the base system 10 will continue monitoring the area for movement. However, if no movement has been detected during a predetermined time period, which may be the time period of the peak hours or a time interval within the peak hours (block 108), then the base system initiates contact with the central monitoring system to alert a dispatcher that no movement has occurred (block 110). No movement during peak hours may be reflective of an emergency or serious health condition that needs immediate attention. The emergency services system 82, family, friends, neighbors, and others listed in the central monitoring system database can then be contacted to determine the condition of the person or persons being monitored.

If movement is detected at block 102 and the base system 10 is in vacation mode (block 112), the central monitoring system is alerted by the base system 10 (block 114). The presence of movement during vacation mode may indicate that unauthorized persons are present at the base system location. Accordingly, the emergency services system 82 or other persons or entities can be contacted to determine the cause of movement at the location. Where both the motion detector 26 and camera 42 are associated with the base system 10, the camera 42 can be automatically put into operation when movement is detected to thereby record movement events as they occur.

If movement is detected at block 102 and the base system 10 is not in vacation mode (block 112), it is determined whether the movement has occurred during peak hours (block 115). If the detected movement has occurred during peak hours, then the total number of detected movements $M_t$ is updated (block 116). The total number $M_t$ can then be compared to a predetermined number of detected movements (block 118) in a giving time period. If $M_t$ does not exceed the predetermined number, the area continues to be monitored (block 100). If however $M_t$ does exceed the predetermined number, $M_t$ is reported to the central monitoring system (block 120). The value of $M_t$ can then be cleared (block 122). The area is then monitored for new movement (block 100). The value of $M_t$ can be stored in the database of the central monitoring station and mad[0085] available to an authorized client system 78 through a web page, email, and so on.

In a system where more than one motion detector is used, each motion detector can include a unique identifier that is transmitted along with motion information to the base system 10 in order to keep track of movement at each motion detector location. If desired, a running total of detected movement vs. time can be graphically displayed and statistical probabilities of movement in the various areas over time can be calculated. As more movement and time data are received at the central monitoring station, a more accurate statistical model of movement can be calculated. The central monitoring system, as well as other concerned persons or entities, can be alerted should significant deviation occur between the statistical model and actual detected movement.

Instead of sending the data when a predetermined total of movements has been detected, the base unit 10 may alternatively send the value of $M_t$ at predetermined time intervals, or at the end of a predetermined time period, such as at the end of a peak hour time period.

If movement has been detected during non-peak hours, then the total number of detected movements $M_{np}$ is updated (block 124). The total number $M_{np}$ can then be compared to a predetermined number of detected movements (block 126) in a given time period. The total number of detected movements for non-peak hours will most usually be less than the total number of detected movements for peak hours. If $M_{np}$ does not exceed the predetermined number, the area continues to be monitored (block 100). If however $M_{np}$ does exceed the predetermined number, $M_{np}$ can be reported to the central monitoring system (block 128). The value of $M_{np}$ can then be cleared (block 130) and the area monitored for new movement (block 100). The value of $M_{np}$ can also be stored in the database of the central monitoring station and made available to an authorized client system 78 through a web page, email, and so on.

Excessive movement during non-peak hours may indicate that the person being monitored is having difficulty and therefore should be contacted to assess the person's condition. Excessive movement may also indicate the presence of unauthorized persons, in which case the central monitoring station can monitor audio levels in the relevant area(s) to determine if further action is necessary.

While the invention has been taught with specific reference to the above-described embodiments, those skilled in the art will recognize that changes can be made in form and detail without departing from the spirit and the scope of the invention. Thus, the described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A method for remotely ascertaining the activity level of an individual, the method comprising:

detecting movement of the individual at a first location with at least one monitoring device;

tabulating a total number of detected movements within a predetermined time period;

transferring the total number of detected movements from the fist location to a second location remote from the first location; and displaying the total number of detected movements at a third location remote from the first and second locations;

wherein the activity level of the individual can be ascertained at the third location from the total number of detected movements.

2. A method according to claim 1, wherein the second location is notified if movement has not been detected within the predetermined time period.

3. A method according to claim 1, and further comprising:

setting an alarm mode at the first location; and notifying at least the second location when movement is detected dung the alarm mode.

4. A method according to claim 1, wherein the monitoring device comprises at least one infrared motion detector.

5. A method according to claim 4, wherein the monitoring device further comprises at least one camera device.

6. A method according to claim 1, wherein the monitoring device comprises at least one camera device.

7. A method according to claim 1, and further comprising storing the total number of detected movements in database at the second location.

8. A method according to claim 7, and further comprising displaying the total number of detected movements on a web page.

9. A method according to claim 8, wherein the web page has a URL address, and further comprising associating the URL address with the first location, such that displaying the total number of detected movements a the third location comprises specifying the URL address.

* * * * *

UNITED STATES PATENT AND TRADEMARK OFFICE

CERTIFICATE OF CORRECTION

PATENT NO. : 6,445,298 B1
DATED : September 3, 2002
INVENTOR(S) : Isaac Shepher

It is certified that error appears in the above-identified patent and that said Letters Patent is hereby corrected as shown below:

Column 10,
Line 10, change “dung” to -- during --.

Signed and Sealed this

Thirty-first Day of December, 2002

JAMES E. ROGAN
*Director of the United States Patent and Trademark Office*